United States Patent [19]

Salmon et al.

[11] Patent Number: 4,899,852

[45] Date of Patent: Feb. 13, 1990

[54] ELEVATOR CAR MOUNTING ASSEMBLY

[75] Inventors: John K. Salmon, South Windsor; Young S. Yoo, Avon, both of Conn.

[73] Assignee: Otis Elevator Company, Farmington, Conn.

[21] Appl. No.: 266,540

[22] Filed: Nov. 3, 1988

[51] Int. Cl.[4] ..... B66B 9/00

[52] U.S. Cl. ..... 187/1 R; 248/581; 248/604; 267/120

[58] Field of Search ..... 187/1 R, 95, 28; 248/560, 562, 565, 603, 604, 610, 612, 581; 267/120, 113

[56] References Cited

U.S. PATENT DOCUMENTS 4,113,064 9/1978 Shigeta et al. ..... 187/1 R
4,660,682 4/1987 Luinstra et al. ..... 187/1 R

FOREIGN PATENT DOCUMENTS 656019 3/1965 Belgium ..... 187/1 R
695566 10/1964 Canada ..... 187/1 R

*Primary Examiner*—Joseph J. Rolla
*Assistant Examiner*—Kenneth Noland
*Attorney, Agent, or Firm*—William W. Jones

[57] ABSTRACT

The elevator car is disposed in a frame which moves on rails through the elevator hoistway. A pendulum mount is used to mount the car in the frame so that the car is free to swing within the frame in pendulum fashion. Both lateral and torsional swinging movement of the car within the frame are controlled. A combination spring/damper assembly interconnects the car and the frame to control such lateral movements of the car whereby the car is softly stabilized within the frame.

10 Claims, 3 Drawing Sheets

ELEVATOR CAR MOUNTING ASSEMBLY

TECHNICAL FIELD

This invention relates to an elevator car assembly, and more particularly to a mounting assembly for positioning an elevator car in a frame which moves on rails through a hoistway.

BACKGROUND ART

Pendulum-type mounts used to position an elevator car in a frame which moves through the elevator hoistway are known in the prior art. An example of one such mount assembly is shown in British Pat. No. 1,407,158 published Sept. 24, 1975. The pendulum mount is desirable because it allows the car to move laterally, both linearly and torsionally within the frame as the frame vibrates during passage through the hoistway. The frame traverses the hoistway on rails via guide rollers which are mounted on the frame. The frame will vibrate during such movement because of misalignment of the tracks in the hoistway; because of steps at joints between successive sections of track; because of misalignment of the guide wheels on the frame; and the like. The frame vibrations will tend to be well defined, sharp occurrences of varying magnitude, depending on the cause, and will be transferred to the car if the car is tightly fixed to the frame. Rubber pads have been used in the past to try to minimize transfer of vibration from the frame to the car, whereby a quieter more comfortable ride is afforded the passengers on the elevator.

The pendulum mount assembly provides a means for transforming the shock-type vibrations imparted to the frame, into lateral, linear or torsional movements of the car. Since the car is suspended in pendulum fashion with respect to the frame, relative motion between car and frame tends, generally, to permit the car to have less, and smoother, motion with respect to inertial space. Since a passenger senses only acceleration with respect to inertial space, such reduced action produces a more comfortable ride.

However, such a simple suspension without damping can produce, as a result of disturbances, car motions with respect to inertial space which repeat at the natural frequency of the system for extended periods. When using the pendulum-type mounting, the lateral movements of the car in the frame must thus be controlled so as to limit the amplitude and period of these movements, while at the same time softening their effect on the car and its riders. In the aforesaid British Pat. No. 1,407,158, rubber pads are disposed between the floor of the car and the frame, and are used to damp the lateral and vertical movements of the car in the frame.

DISCLOSURE OF INVENTION

This invention relates to an improved pendulum-type assembly for mounting an elevator car in a frame. The lateral movements of the car with respect to the frame are controlled by a combination spring/damper assembly which interconnects the car with the frame. The combination assembly thus has the characteristics of a damper when the car is gently swayed laterally, and also has the characteristics of a spring when the car is sharply swayed laterally. The dashpot proportions and size are tailored so as to produce the proper compliance, due to compressibility of a volume of air, and viscous damping so that the transmitted cab accelerations are limited and the persistent natural sways after sudden disturbances are limited. The control of lateral movement in the car occurs in all lateral directions, i.e., in a 360° arc, and also applies to torsional movement of the car with respect to the frame.

The car is suspended in the frame by four metal rods secured to the floor of the car, one at each corner of the car, and secured to an overhead portion of the frame. The stiffness of the rods is selected so as to have no substantial effect on the pendulum movement of the car in the frame. Thus, the rods effectively act as strings on which the car is suspended. Controlling lateral movement of the car with respect to the frame is affected solely by the spring/damper assemblies which interconnect the floor of the car with the lower portion of the frame. The spring/damper assemblies are preferably pneumatic piston-cylinder units commonly known as pneumatic dash pots which have been modified to ensure that the flow of air into and out of the cylinder is always laminar, irrespective of the amount of driving force applied to the piston. Thus, as the piston strokes into and out of the cylinder in response to lateral movements of the car with respect to the frame, laminar airflow, rather than turbulent airflow will always result between the piston and cylinder. The assemblies of course will be tailored to operate in this fashion throughout a predetermined range of lateral forces which will occur as the car swings laterally in the frame under normal operating conditions. In order to achieve this controlled movement of the car, the spring/damper assemblies are arranged in sets so that the entire 360° sweep of possible linear lateral movements will be countered, as well as arcuate torsional movements the car will be subjected to. Preferably, the spring/damper assemblies are arranged in a rectangular array which is offset 45° from the geometry of the car. At least one of the assemblies in the array will always be contracted by movement of the car. Generally, two of the assemblies will be contracted and the remaining two assemblies will be expanded. The specific two which are contracted, and the specific two which are expanded will, of course, depend on the direction of movement of the car.

It is therefore an object of this invention to provide an improved elevator car mounting system for use in an elevator assembly.

It is a further object of this invention to provide a mounting system of the character described which employs a pendulum-type mount for suspending the car in a frame.

It is an additional object of this invention to provide a mounting system of the character described which includes a spring/damper system for controlling lateral movement of the car in the pendulum mount.

It is another object of the invention to provide a mounting system of the character described wherein the spring/damper system is operable to stabilize lateral movement of the car in all potential directions.

These and other objects and advantages of the invention will become more readily apparent from the following detailed description of a preferred embodiment thereof, when take in conjunction with the accompanying drawings, in which:

BEST MODE FOR CARRYING OUT THE INVENTION

Figure 1:
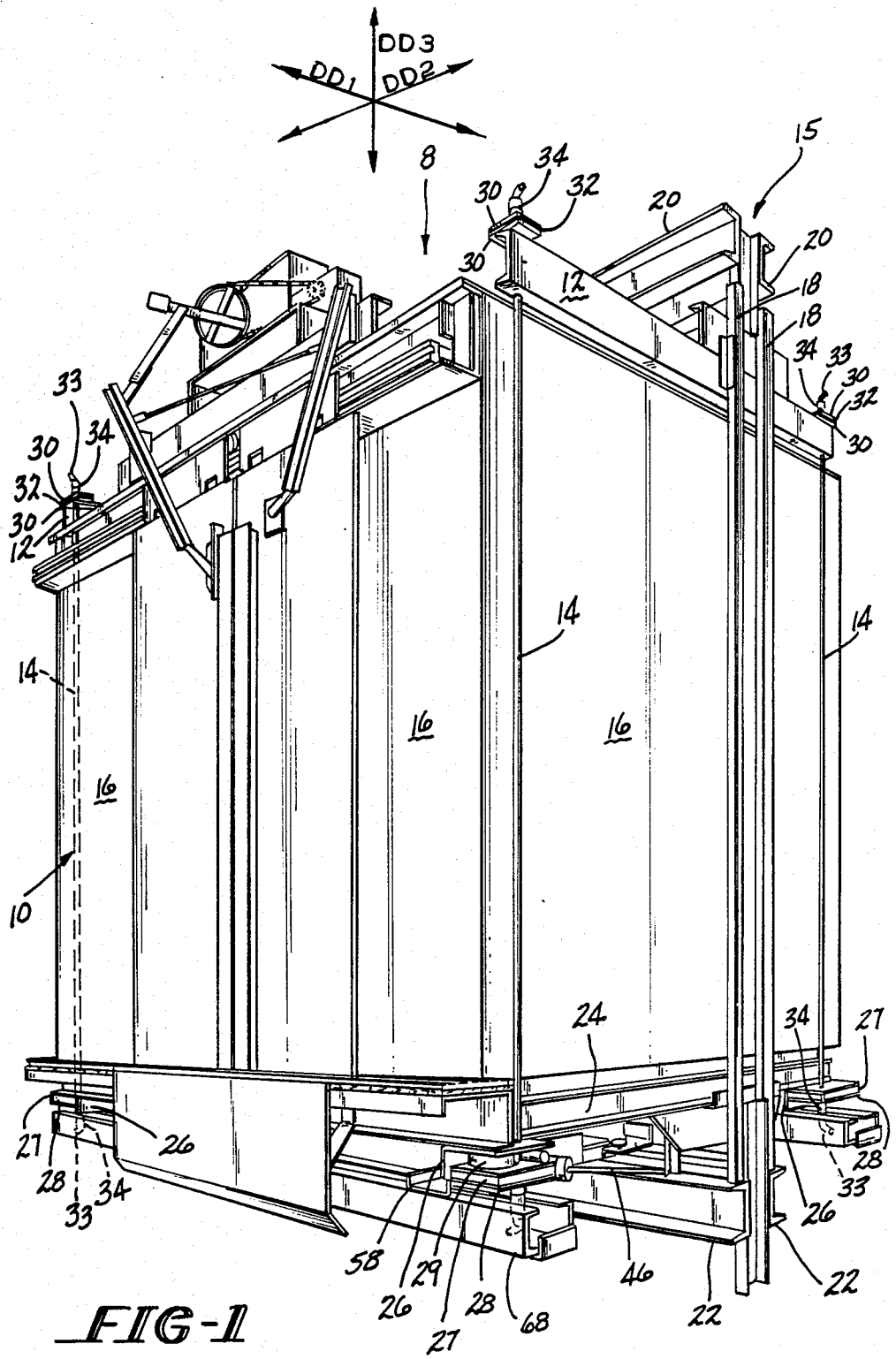
FIG. 1 is a perspective view of an elevator car mount assembly embodying the present invention taken from a position slightly below the car looking at the elevator car doors, which are in a closed position.
Figure 2:
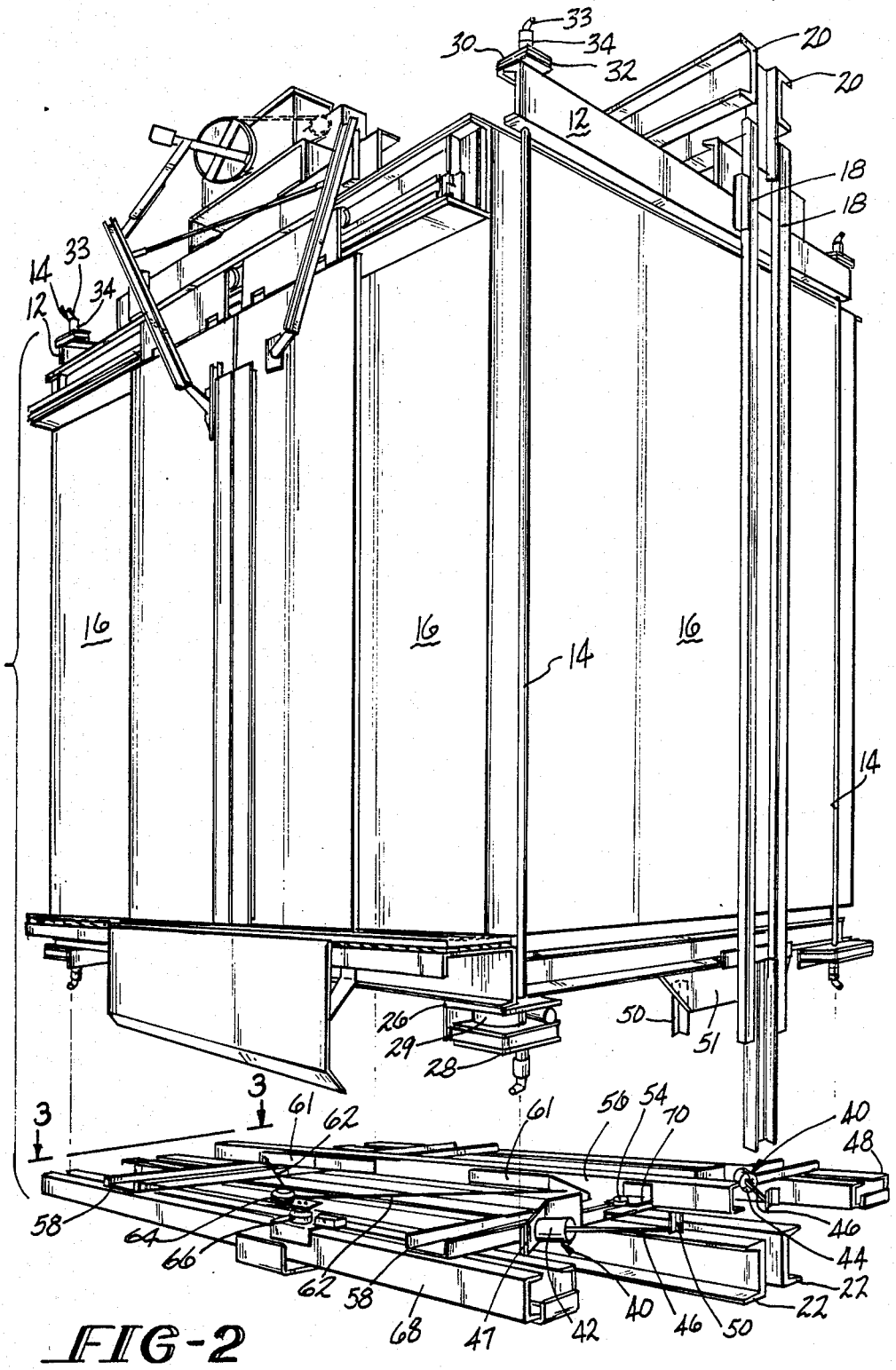
FIG. 2 is a view similar to FIG. 1 with the lower portion of the car mounting having been exploded to expose the components lying beneath the elevator cab.

Referring to FIGS. 1 and 2, an elevator car assembly denoted generally by the numeral 8 includes a cubical elevator car 10 which is suspended from two parallel U-beams 12 by four suspension rods 14, one of which is located adjacent each corner of the car 10. The car has four walls 16, two of which are visible in the perspectives in FIGS. 1 and 2. The U-beams 12 and suspension rods 14 are part of the car assembly frame denoted generally by the numeral 15, which frame 15 also includes side vertical supports 18, to which the U-beams 12 are welded; and top and bottom support beams 20 and 22, respectively, which are welded to the side vertical supports 18.

The car walls 16 are joined together to form a cubical car that rests on four beams 24 that are welded to four support pads 26 (one below each corner of the car). One of the suspension rods 14 extends through each support pad 26, passing through a noise deadening rubber pad 27 and a second support pad 28. The two support pads 26 and 28 sandwich the rubber pad 27. Below two corners of the car, a force transducer 29 separates the pads 26 and 28. The transducer 29 provides electrical signals manifesting the load in the car. Donofrio et al. U.S. Pat. No. 4,330,836, also assigned to Otis Elevator Company provides a discussion on using force transducers to measure cab loads. Each rod 14 extends through the beams 12, through two top support pads 30 that sandwich a second noise deadening rubber pad 32. Both ends 33 of each rod 14 are bent, crimped or otherwise secured and stop collars 34 are attached to the rods between the rod ends 33 and the support pads 28 and 30.

The selection of the suspension rods 14 takes into account the expected cab load, rod rigidity and the natural frequency of the cab motion as compared to the frequency of sideways motion of the frame that can be expected as the car moves in the elevator shaft. As discussed earlier, the frame can be pictured as having rollers that roll along guide rails that extend the length of the elevator hoistway. In following the rails, the frame will shimmy sideways, that is it vibrates in the two directions DD1 and DD2 that are normal to the direction of travel DD3, and in vectors thereof. The car 10 will also undergo torsional movement within the frame 15 as the former is subjected to vibrations of the latter.

The rods 14 will be selected so as to be sufficiently flexible to allow the car 10 to swing within the frame 15 in response to vibrations of the latter. Additionally, the flexibility of the rods 14 should be such as not to influence the swinging of the car 10 within the frame 15. The flexibility of specific rods 14 will then vary depending on the size and weight of the specific car in the assembly. It will then be appreciated that the car 10 is free to swing from the top supports 12. Actual swinging motion is, of course, very small, but nevertheless, must be damped. To accomplish this, the car has an undercarriage that contains damper units 40. Each damper unit 40 consists of a cylinder 42, a piston 44 which slides in the cylinder 42, and flexible rod 46 that is attached to the piston 44. FIG. 2 shows that the cylinder 42 is rigidly attached to a bracket 47 on the bottom of the car. The rod 46, on the other hand, is rigidly attached to a small bracket 50 that extends down from a plate 51 secured to the frame supports 18. Thus, the cylinders 42 are connected to the floor of the car 16, and the piston rods 46 are connected to the frame 8. There are four of these spring/damper units 40 and they are located essentially in pairs on each side of the part of the frame below the car (see FIG. 3).

Figure 3:
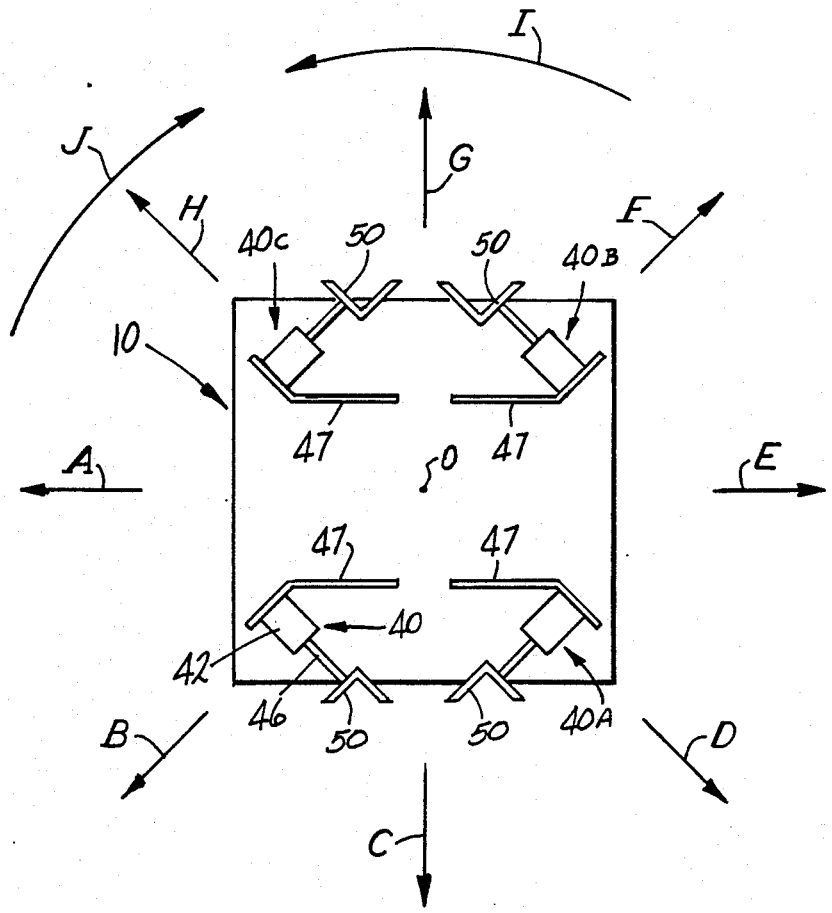
FIG. 3 is a plan view of the spring/damper assembly mounted below the floor of the car.

Referring now to FIG. 3, the geometry of the spring/damper assembly is shown in plan. The vertical axis of symmetry of the car 10 and frame is designated by the letter O. The individual spring/damper units are designated 40, 40A, 40B and 40C for purposes of explanation as to their operation. Directions of lateral linear motion of the car 10 designated by the radial arrows A–H, and directions of torsional lateral motion of the car 10 are designated by the arrows I and J. If the car 10 were to move torsionally in the direction of the arrow I, then the spring/damper units 40 and 40B will contract, and the units 40A and 40C will expand. If the car 10 were to move torsionally in the direction of the arrow J, then the units 40A and 40C will contract and the units 40 and 40B will expand. Thus, the system provides complete control and damping of all torsional movement of the car 10. As for lateral movement, when the car 10 moves in the direction of the arrow A, the units 40A and 40B contract, and the units 40 and 40C expand. If the car moves in the direction of arrow E, then the opposite is true. Movement of the car in the direction of the arrow C causes contraction of the units 40 and 40A with concurrent expansion of the units 40B and 40C; while the opposite occurs when the car moves in the direction of the arrow G. If the car 10 moves in the direction of the arrows B, D, F and H, then the units 40A, 40, 40C and 40B, respectively, will contract, and the units 40C, 40B, 40A and 40, respectively, will expand. It will be noted that all linear directions of lateral movement in a 360° arc about the axis 0 will be damped by the units. The piston rods 46 in each unit will be sufficiently flexible so as to be able to bend when the movements approach the diagonal directions B, D, F and H. Thus, the rods 46 on the units 40 and 40B will flex or bend when the car 10 moves in the direction of the arrows B or F; or in vectors close to the arrows B or F.

Figure 4:
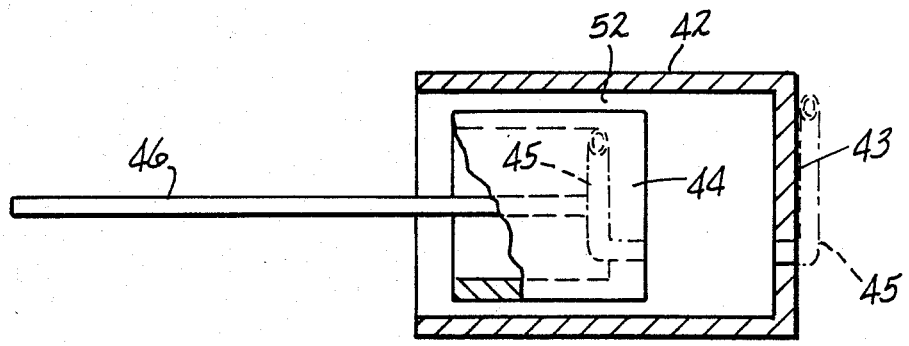
FIG. 4 is a sectional view taken along the axis of one of the spring/damper units.

Referring now to FIG. 4, details of the unit 40 are shown. It will be noted that cylinder 42 does not have any bleed port in its end wall 43. The piston 44 has an outside diameter which is sized with respect to the cylinder bore as to ensure a sufficiently small gap 52 between the piston and cylinder bore to provide for laminar airflow from the cylinder 42 past the piston 44 whenever the piston 44 is driven into or out of the cylinder 42. The gap 52 should never be large enough that turbulent airflow through it will result when the piston is driven into or out of the cylinder. Given the weight of the car, loaded and unloaded, and the range of vibrations that the frame will be subjected to in a hoistway, one can calculate the magnitude of forces that the pistons will be subjected to during normal elevator usage. The gap 52 can thus be tailored so that when subjected to this range of driving forces, the flow of air from the cylinder past the piston will always be laminar. With this laminar flow, the damping force of the device is proportional to the speed of the air displaced through the gap. This is a key to maintaining consistent damping and to enable linear vector addition of damping forces among the four dampers. In turn, this enables the development of essentially equal damping for all directions of platform motion. When laminar airflow is maintained in this manner, the units 40 will act as dampes when subjected to small shocks below a given level, and will act as springs when subjected to larger shocks above that given level. This dual mode of operation is important because the damping function is needed to damp out oscillations after a disturbance and the spring function is needed to limit the force transmitted when the frame moves very abruptly. The spring function acts as a force limiter.

A specific embodiment of the device illustrative of the system is as follows:

| A specific embodiment of the device illustrative of the system is as follows: | | |
|---|---|---|
| Empty Car and Platform Weight | | 3000 lbs. |
| Passenger Load Capacity | | 3500 lbs. |
| Range of Supported Loads | | 3000 to 6500 lbs. |
| Support Rods | 4 steel rods @½" diameter | |
| Rod Lengths | 118 inches | |
| Dampers | Effective damping each 22 lbs. sec/inch | |
| | Effective spring rate = 100 lbs./inch | |
| Four dampers along edges of a square with 50 inch sides. | | |
| Piston diameters = 5 inches | | |
| Center of operating range of pistons is about 2.5 inches from head end of the cylinder. | | |

An alternative design for the dampers has piston clearances extremely small such that the leakage would produce more damping force than the system needs. A parallel air leakage path is then provided using a long small diameter leakage path through either the piston or cylinder. The path should also be dimensional to give laminar flow. One convenient means is to insert a "capillary" tube of proper size, with a length no less than 10 diameters of the opening. Adjustment of the total damping value is adjustable by changing the tube used. In the alternative design, flow tubes 45 (shown in phantom in FIG. 4) could be used to communicate with the air space in the cylinder 42, either through the piston 44 or the end wall 43 of the cylinder 42.

The car assembly 8 also includes an arrangement for restraining the motion of the car 10 when the car 10 is at a floor, this being required because the car 10 can swing so easily within the frame 15. The car 10 is pulled into engagement with stops 54 on the frame 15, (see FIG. 2). Stops 54, which may consist of a rubber foot, are rigidly attached to the frame by cross members 58, which are rigidly attached to the lower supports 48. Two angled brackets 61 are welded to member 56. A cable 62 extends from these brackets to an actuator on arm 64, which is attached to an actuator 66 that is fixed to the support 68, which is rigidly attached to members 58, and is thus part of the frame 15. The actuator 66 is de-energized when the car 10 stops at a landing, thus causing the arm 64 to rotate towards the front of the car. The cables 62 are pulled towards the front of the car, pulling the car forward. Small brackets 70 on the bottom of the car then engages the stops 54. The car is thus pulled tightly against a rigid stop holding to hold the car 10 in place on the frame 15. This operation will take place as passengers enter or exit the car.

Any actuator of the type shown in copending application S.N. (Attorney Docket No. OT-741) may be provided to drive the car forward with respect to the car frame, thus bottoming it against stops on the frame and immobilizing it with respect to the frame. The actuator is preferably arranged to be in the car immboilizing state when unenergized and car-free state when energized. Thus, loss of electric power locks the car in position such that the sill-to-car gap is controlled and the elevator door operation system meshes properly with hoistway door elements.

In normal use this type of actuator is energized as a car accelerates at a start, and is de-energized during deceleration as its approaches its destination. This method tends to obscure the action from the passengers. Since they are adjusting to a vertical acceleration of typically one-eighth of a g. a possible horizontal acceleration of less than a tenth as much will be unnoticeable.

The foregoing is a description of the best mode for carrying out the invention, but one skilled in the art will, having had the benefit of the foregoing description, may make modifications and variations to all or part of the invention described herein without departing from its true scope and spirit, as defined by the appended claims.

We claim:

1. An elevator car assembly comprising:

(a) a frame adapted to travel through an elevator hoistway;

(b) an elevator car for holding passengers;

(c) pendulum means for mounting said elevator car in said frame in pendulum fashion whereby said elevator car can move laterally within said frame; and (d) damping means interconnecting said frame and said elevator car for damping lateral movement of said elevator car through a 360° lateral arc, said damping means including means for acting as a spring when said frame is subjected to substantial shocks in the hoistway, and for acting as a damper when the frame is subjected to smaller shocks in the hoistway, said damping means comprising a plurality of pneumatic dashpots operable to induce only laminar internal airflow when subjected to the full range of lateral forces normally encountered during operation of the elevator car assembly in the hoistway.

2. The elevator car assembly of claim 1 wherein there are four pneumatic dashpots, each of which operates along an axis which is disposed at an angle of 45° to the planes of the elevator car walls.

3. The elevator car assembly of claim 1 wherein each dashpot includes a cooperating piston and cylinder, and the laminar airflow is obtained by forming a sufficiently narrow gap between the piston and cylinder bore.

4. The elevator car assembly of claim 1 wherein each dashpot includes a cooperating piston and cylinder, and the laminar airflow is obtained by use of a tubular air bleed sized to avoid the formation of turbulent airflow from an air pocket formed by the piston and a closed end of the cylinder.

5. The elevator car assembly of claim 1 wherein said pendulum means comprises a plurality of rods disposed adjacent each corner of said elevator car, said rods being connected at one end to an upper portion of said frame, and at an opposite end to a lower portion of said elevator car.

6. The elevator car assembly of claim 5 wherein said rods have a stiffness such that lateral oscillations of said elevator car in said frame are substantially unaffected by said rods.

7. The elevator car assembly of claim 1 further comprising means for steadying said elevator car in said frame when said assembly is stopped at a landing in the hoistway.

8. An elevator car assembly comprising:

(a) a frame adapted to travel through an elevator hoistway;

(b) an elevator car for holding passengers;

(c) pendulum means for mounting said elevator car in said frame in pendulum fashion whereby said elevator car can swing laterally within said frame; and (d) spring/damper means interconnecting said frame and said elevator car for moderating lateral swinging of said elevator car in said frame, said spring/damper means operating in linear directions, and having a plurality of operating directions angularly offset from each other so as to moderate linear lateral swinging of said elevator car throughout a 360° horizontal arc, and also moderate horizontal curvilinear torsional swinging of said elevator car in both the clockwise and counterclockwise directions, said spring/damper means comprising a plurality of pneumatic dashpots each having a cooperating piston and cylinder, and wherein each of said operating directions is defined by a stroke direction of at least one of said pistons.

9. The elevator car assembly of claim 8 wherein said dashpots are paired so that lateral or torsional swinging of said elevator car in said frame will compress one of said dashpots in a pair while extending the other of said dashpots in the same pair.

10. The elevator car assembly of claim 9 wherein said dashpots are four in number and arranged in two pairs of dashpots, one of said dashpots in each pair thereof being disposed adjacent each corner of said elevator car, with the stroke direction of each piston being generally perpendicular to an imaginary line connecting diagonally opposite corners of said elevator car.

* * * * *

UNITED STATES PATENT AND TRADEMARK OFFICE

CERTIFICATE OF CORRECTION

PATENT NO. : 4,899,852

DATED : February 13, 1990

INVENTOR(S) : John K. Salmon and Young S. Yoo

It is certified that error appears in the above-identified patent and that said Letters Patent is hereby corrected as shown below:

In Column 4, line 20 after 10 insert --are--.

In Column 5, line 44 after tube insert --length--.

In Column 6, line 8 delete "immboilizing" and insert -- -immobilizing--

In Column 8, line 13 delete "extending" and insert --expanding--.

Signed and Sealed this

Seventh Day of May, 1991

*Attest:*

HARRY F. MANBECK, JR.

*Attesting Officer*

*Commissioner of Patents and Trademarks*